United States Patent [19]

Radtke et al.

[11] Patent Number: 4,621,964

[45] Date of Patent: Nov. 11, 1986

[54] VALVE MOUNTING ASSEMBLY FOR AEROSOL CONTAINERS AND THE LIKE

[75] Inventors: Werner A. Radtke, Vernon Hills; Joseph L. Roe, Des Plaines, both of Ill.

[73] Assignee: Plastic Specialties and Technologies, Inc., Schiller Park, Ill.

[21] Appl. No.: 677,555

[22] Filed: Dec. 3, 1984

Related U.S. Application Data

[62] Division of Ser. No. 395,434, Jul. 6, 1982.

[51] Int. Cl.[4] ..... B21D 51/46

[52] U.S. Cl. ..... 413/9; 220/67

[58] Field of Search ..... 220/67; 222/402.1, 542, 222/6; 413/1, 9, 26

[56] References Cited

FOREIGN PATENT DOCUMENTS 003626 8/1981 European Pat. Off. ..... 220/67

2417629 10/1974 Fed. Rep. of Germany .

*Primary Examiner*—Leon Gilden

*Attorney, Agent, or Firm*—Wood, Herron & Evans

[57] ABSTRACT

In the formation of a valve mounting assembly for aerosol containers and the like, an aerosol valve mounting cup including a projecting central cylindrical body with an outwardly directed annular channel about the end thereof, an annular planar gasket deformably receivable within the channel, and apparatus for positioning the gasket in the channel. The inner periphery of the gasket defines a diameter substantially less than that of the cylindrical body whereby forceable engagement of the gasket about the body and into the channel outwardly deforms the inner peripheral portion of the gasket into a sleeve-like configuration intimately engaged with the cylindrical body thereabout, the remainder of the gasket seating within and conforming to the annular channel. Engagement of the gasket into the channel utilizes a gasket receiving bushing with a longitudinally moveable inserter therein which forces the gasket into the channel as the apparatus moves over a mounting clip.

6 Claims, 10 Drawing Figures

VALVE MOUNTING ASSEMBLY FOR AEROSOL CONTAINERS AND THE LIKE

This is a division of application Ser. No. 395,434, filed July 6, 1982.

BACKGROUND OF THE INVENTION

In aerosol containers and the like, the dispensing valve is normally mounted to the container through the use of a valve mounting assembly comprising a mounting cup and an associated gasket. The mounting assembly includes a gasket receiving channel which is positioned over and clinched to the rolled rim of the container about the upper end thereof. The mounting cup is typically clinched to the upper part of the container by a device which displaces radially outwardly the cylindrical wall of the mounting cup.

Much effort has been directed to the provision of the gasket or gasket seal within the cup to ensure a positive sealing of the cup to the container in a manner which minimizes loss of the pressurized contents.

In its simplest form, the gasket can comprise a conventional flat rubber washer or annular gasket which is loosely received about the central body of the cup and sits freely within the channel. Such gaskets are relatively expensive and could, due to the relatively loose reception within the mounting cup, be displaced during the handling of the mounting assembly prior to and during the final securement to the container. Such gaskets are especially susceptible of movement during the propellant filling operation and during valve assembly, impairing the clinching operation. In addition, pre-cut gaskets generally reside only in the receiving channel of the mounting cup and do not provide a seal in the critical area at which the mounting cup is clinched to the container.

A more common type of gasket currently in commercial use is a "flowed-in" gasket in which a liquid solvent-based gasket-forming composition is deposited in the channel, caused to flow over the surfaces thereof, the solvent evaporated from the material, and the remaining material cured. This is an expensive procedure requiring multiple production steps including the use of curing ovens or other means for effecting the drying and curing of the gasket material, and solvent removal means such as hoods and venting ductwork, in the case of non-aqueous solvents. Further, means must be provided for rotating the mounting cup beneath a metering apparatus which dispenses carefully determined amounts of gasket-forming composition. The mounting cup must be handled carefully to maintain it in a horizontal position before the gasket solidifies. The resulting gasket tends to be of nonuniform thickness in the clinch area of the cup and container. U.S. Pat. No. 3,342,381 (Simons et al) discloses a "flowed-in" gasket.

Another technique for disposing a gasket on the mounting cup is described in U.S. Pat. No. 3,417,177 (Simons et al). That patent discloses a method comprising positioning a circular band of heat-shrinkable material over a portion of the cylindrical wall of the mounting cup and thereafter heating the cup to shrink the band of material into contact with the cup wall.

U.S. Pat. No. 3,443,006 (Simons, et al) discloses a method wherein a band of gasket material is swelled into place using a suitable swelling agent.

The heat shrinking and swelling methods are time consuming and require relatively expensive equipment to either heat the material or to recover swelling agent.

Another form of gasket currently in use is a sleeve gasket involving a tube of low density polyethylene which is inserted around the central cylindrical body, extended at least partially into the annular channel, and then cut to the proper length. Such a sleeve gasket has some advantages over the aforedescribed gaskets in the elimination of the complex and time consuming curing and solvent removal procedures. However, the procedures and equipment involved in the utilization of an extruded polyethylene tube are complex, particularly if an intimate, frictional engagement of the sleeve gasket with the body wall is to be achieved. The tube insertion and cutting operations must be carefully performed to properly seat the tube onto the mounting cup. It is difficult to dispose the polyethylene tube more than about halfway into the receiving channel. European Patent Application No. 81300339.9 more fully discloses the use of polyethylene tubes to form gaskets.

SUMMARY OF THE INVENTION

The present invention proposes a gasket and a gasket positioning procedure which constitute significant advances in the art as heretofore developed, producing significant savings in both production time and materials. The resultant mounted gasket, similar in appearance to the mounted sleeve gasket previously described, is formed and mounted to provide a positive frictional engagement with the mounting cup during the positioning of the gasket, providing a sealing capability which is consistant and as or more effective than any commercially feasible system heretofore devised, notwithstanding the unique simplicity of the gasket and mounting procedure involved. In addition, the method of application of the gasket of the present invention eliminates a step required in the installation of the abovedescribed sleeve gasket in that the former does not require cutting to size after installation.

The method of this invention allows placement of a gasket on the mounting cup over the entire area at which sealing can be effected. Unlike with "flowed-in" gaskets and precut gaskets, the method of this invention conveniently provides a gasket of substantially uniform thickness at the clinch area between the cup and container. Unlike with the polyethylene tube gasket, the method of this invention provides a gasket which can occupy any desired portion of the receiving channel of the mounting cup. Thus, the gasket can be positioned such that the maximum sealing area possible can be obtained.

The gasket of the valve mounting assembly of the present invention is in the nature of a thin planar annular sheet of an appropriate self-sustaining deformable material of from about 0.007 inches in thickness of about 0.025 inches in thickness. The gasket material is preferably a plastic or elastomeric material, or a combination of such materials. The gasket material is most preferably low density polyethylene approximately 0.014 inches in thickness. This most preferred material is basically the same material and material thickness as the above referred polyethylene tubes used in the formation of sleeve gaskets. In applications in which increased flexibility and resistance to stress cracking is required it has been found advantageous to employ a gasket comprising low density polyethylene and one or more additives, such as butyl rubber, in amounts of up to about 50 weight percent.

The planar or flat gasket of the present invention includes an inner periphery having a diameter at least slightly less than that of the diameter of the projecting cylindrical body of the mounting cup. The inside diameter of the gasket of the present invention will be on the order of about one eighth-inch less to about one-half inch less than the diameter of the cylindrical body of the mounting cup. The outer diameter of the planar gasket is up to about one-eighth inch greater than the outer diameter of the mounting cup defined by the peripheral edge of the outwardly rolled flange which forms the gasket receiving channel. The exact dimensions of the gasket will depend on the dimensions of the mounting cup and on the gasket material. The gasket should be of such dimensions that when installed by the method recited herein the gasket substantially completely fills the volume between the rolled rim of the container and the mounting cup.

The cylindrical body of the conventional 1 inch aerosol mounting cup used with a pre-cut or "flowed-in" gasket has an outside diameter of from about 0.98 inches to about 0.99 inches. In the preferred embodiment of the method of this invention, the gasket is disposed on the cylindrical wall of the mounting cup, as well as at least partially in the receiving channel. Consequently, the diameter of the mounting cup is slightly less than the conventional mounting cup to accommodate the thickness of the gasket. For gaskets of the preferred thickness of 0.014 inches, satisfactory results can be obtained with mounting cups of diameters in the range of from about 0.95 inches to about 0.96 inches.

In positioning the gasket within the mounting cup, the gasket is coaxially aligned over the cylindrical body and forced inward thereover, deforming as it moves due to the inherent flow characteristics of the sheet material, into a configuration which conforms to the annular channel and the cylindrical adjacent portion of the cylindrical body. The gasket, when installed, is in intimate frictional engagement with the body wall, precluding any possibility of leakage, displacement, or the like.

Actual installation of the annular flat gasket can be effected simply and expeditiously utilizing apparatus including a guide bushing which receives the flat gasket, and an associated inserter which, upon an alignment of the gasket with the mounting cup, forces the gasket into position on the mounting cup in a single operation. The inserter may incorporate an internal spring biased centering unit which includes a cup engaging projection and a gasket seat to facilitate alignment of the gasket and cup during the gasket mounting operation.

Other objects and advantages of the invention may become apparent as the details of the invention are more fully hereinafter described.

DESCRIPTION OF THE PREFERRED EMBODIMENT

Figure 1:
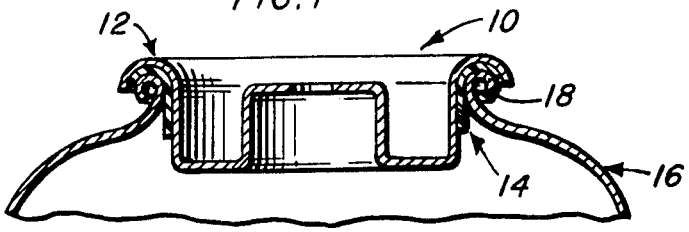
FIG. 1 is a cross-sectional detail illustrating the relationship between the valve mounting assembly of the present invention and a container to which it is to be mounted.

Referring now more specifically to the drawings, reference numeral 10 designates the valve mounting assembly of the present invention. This assembly includes a valve mounting cup 12 of generally conventional construction, and a gasket 14, unique in both its construction and manner of association with the mounting cup.

FIG. 1 illustrates the valve mounting assembly 10 positioned within the open end of a container 16 to which it is to be sealed. The container 16 includes a rolled rim 18 directly receiving and supporting the appropriate peripheral portion of the assembly 10.

Figure 2:
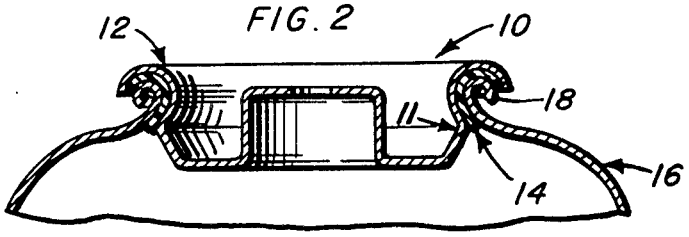
FIG. 2 is a cross-sectional detail of the mounting cup and container in a clinched relationship.

FIG. 2 illustrates the valve mounting assembly 10 after having been clinched to container 16. To ensure an effective, lasting seal the gasket 14 should be positioned such that it intimately contacts the mounting cup 12 and the container 16 along the entire circumference of clinch 11.

Figure 4:
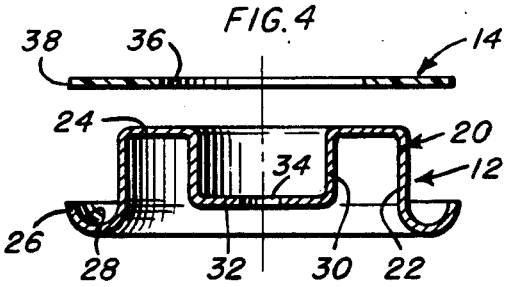
FIGS. 4, 5 and 6 illustrate, sequentially, the mounting of the gasket.
Figure 3:
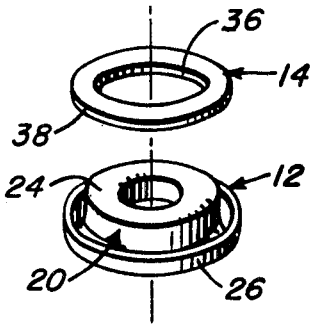
FIG. 3 is an exploded perspective view of a mounting cup and the planar gasket of the present invention.

In order to more particularly appreciate the structure of the mounting cup 12 and the gasket 14, attention is directed to FIGS. 3 and 4 wherein the cup 12 is illustrated in an inverted position and the gasket 14 positioned upward therefrom. The mounting cup 12 includes a central cylindrical body 20 defined by an annular skirt or body wall 22 extending integrally from a circular base 24 and terminating in an outwardly and reversely rolled flange 26. The outwardly rolled flange 26 defines an annular gasket receiving channel 28 surrounding the body 20. Centrally within the base 24 is a cylindrical well or boss 30 terminating in a circular end panel 32. The end panel 32 in turn has a central valve receiving aperture 34 therethrough. This construction is basically conventional in aerosol containers and the like.

With this basic construction, it is essential that a positive pressure resistant seal be provided between the cup 12 and the container 16 itself, and more particularly between the rolled rim 18 of the container 16 and both the channel 28 defined by reversely rolled flange 26 and the adjacent portion of the cylindrical body wall 22 of the body 20. This positive sealing is provided by utilization of the unique gasket 14 of the present invention. The gasket is in the nature of a flat or planar annular disk of low density polyethylene having a constant thickness of approximately 0.014 inches. Such gaskets can be both readily and economically stamped from thin polyethylene sheets and are, because of the inherent nature of the material thereof, capable of deforming into intimate engagement with the mounting cup channel 28 and adjacent wall as shall be detailed presently.

The sheet-like gasket 14 includes an inner annular periphery 36 and an outer annular periphery 38. The inner periphery 36 is of a diameter substantially less than that of the diameter of the cylindrical body 20. As an example, the diameter of the cylindrical body 20 will normally be on the order of 0.96 inches, with the associated gasket having an inner diameter which may be approximately one-eighth inch less to approximately one-half inch less, providing an approximate one-sixteenth inch to one-quarter inch overlap when the gasket 14 is positioned in overlying coaxial arrangement with the base 24 of the body 20. This relationship will be best appreciated from FIGS. 4 and 5 of the drawings. The diameter of the outer periphery 38 of the gasket 14 is from approximately one-eighth inch less than, to upto about one-eighth inch greater than, that of the mounting cap 12 itself as defined by the outer edge of the rolled flange 26.

The gasket 14, in light of its configuration and size relationship to the mounting cup, in conjunction with the inherent properties of the material, is innovatively adapted to provide an economical and highly effective seal. This is achieved by the unique expedient of incorporating the gasket 14 into the mounting assembly 10 in the manner sequentially illustrated in FIGS. 4, 5 and 6. Basically, the flat gasket 14 is coaxially aligned over the inverted mounting cup 12. When so aligned, approximately one-eighth inch or more of the inner peripheral portion of the gasket overlies the base 24 of the cylindrical body 20. The outer periphery 38 of the gasket generally aligns above the annular edge of the outwardly rolled flange 26. This relationship is shown in FIG. 4.

Figure 5:
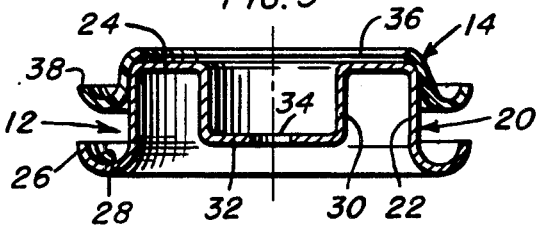

Noting FIG. 5 in particular, the gasket is then forcibly moved inward over the cylindrical body 20, deforming as it telescopes over the body to enter into an intimate frictional engagement with the cylindrical wall 22 of the body 20. The inherent properties of the low density polyethylene of the gasket 14 allow for this flowing deformation of the planar member into a body engaging tubular configuration with the gasket, in its innermost position, including both a body encircling tubular or sleeve-like configuration and a channel conforming annular portion. The final seated position of the gasket will be best appreciated from FIG. 6. It is preferred that in the final seated position the gasket be disposed on the wall 22 at the circumference at which the mounting cup and container are clinched, indicated by A in FIG. 6. It is also preferred that the gasket be disposed at at least approximately the mid-point of the receiving channel 28, indicated by B in FIG. 6.

Unlike with flowed-in gaskets and pre-cut gaskets, the method of this invention allows the easy disposition of a gasket on any portion of wall 22. Unlike with tube gaskets, the method of this invention allows the easy disposition of a gasket in any portion of the receiving channel 28.

In summary, the flat gasket, in essentially a single step, is forcibly introduced over the cylindrical body of the mounting cup with the gasket deforming through engagement with the cylindrical body into intimate frictional engagement with both a substantial portion of the cylindrical body and the peripheral gasket receiving channel thereabout. Thus, a highly effective seal is achieved without the expenses, extensive apparatus, and operational difficulties encountered in the systems presently used, including flow-in seals requiring a material curing and the like, and the use of extruded tubular gaskets requiring forming members and a cutting step after installation.

Figure 6:
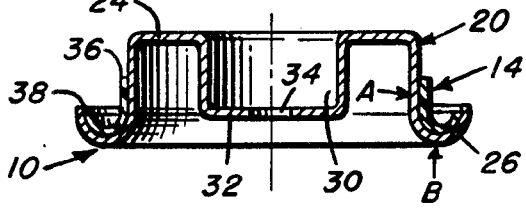
Figure 7:
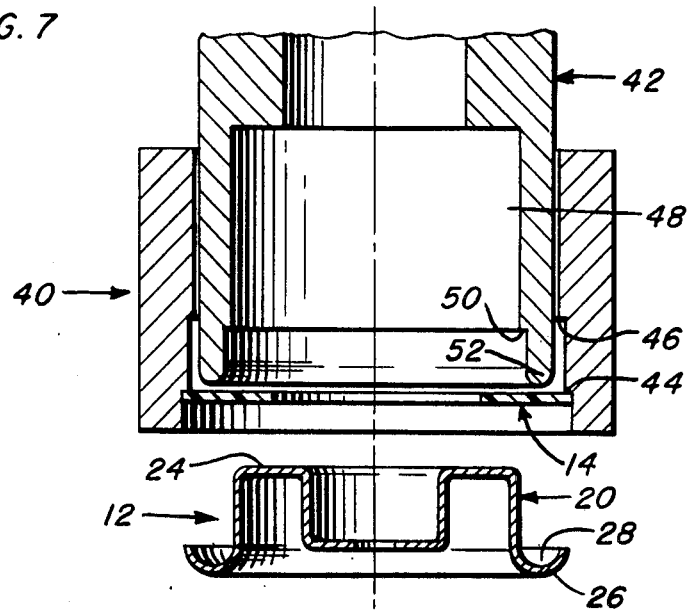
FIGS. 7 and 8 illustrate one embodiment of apparatus which may be used in the single operation mounting of the gasket.
Figure 8:
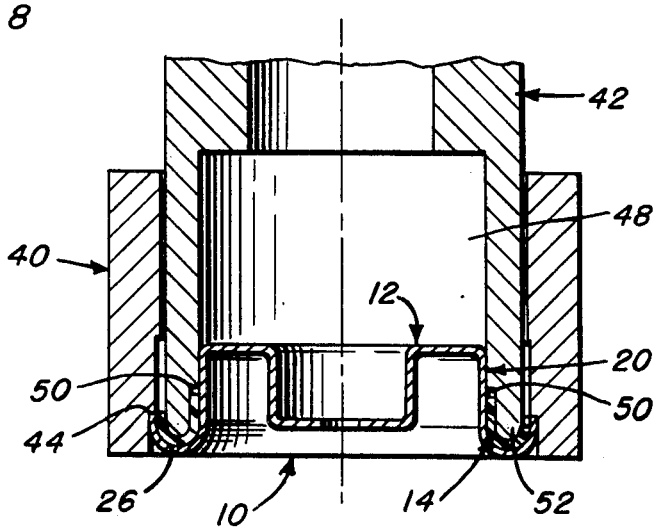

One form of the apparatus for assembling the gasket 14 to the mounting cup 12 has been illustrated in FIGS. 7 and 8, which also present two of the stages in the assembly procedure generally corresponding to those of FIGS. 4 and 6.

The apparatus includes a tubular guide bushing 40 having a central passage therethrough receiving, for relative longitudinal movement therein, an elongated tubular inserter 42. The guide bushing 40, and more particularly the internal passage therethrough, is inwardly stepped at two points therealong, defining first and second annular shoulders or seats 44 and 46. The first annular shoulder 44 is inwardly set from the lower end of the bushing a distance slightly greater than the height of the formed channel 28 of the mounting cup 12. The second shoulder 46 is inwardly spaced from the first shoulder 44 by a relatively greater amount.

The inserter 42 includes a downwardly opening chamber 48 having a single inwardly directed step therein defining an annular shoulder or seat 50 spaced upwardly from the annular lower edge of the tubular inserter 42 a distance greater than the height of the gasket receiving channel 28 of the mounting cup and at a height generally corresponding to the desired height of the formed sleeve-like body surrounding portion of the gasket in its finally seated position. The lower annular edge 52 of the inserter 42 is rounded or configured to generally conform to the channel 28 to ensure a proper seating of the gasket within the channel. By the same token, the width or thickness of the peripheral edge portion of the inserter below the shoulder is such as to move the gasket, in cooperation with the mounting cup, in the sequence of FIGS. 4, 5 and 6.

In using the apparatus of FIGS. 7 and 8, the gasket 14 is positioned, in any appropriate manner, within the lower portion of the guide bushing immediately below the shoulder 44, this portion being configured to closely receive both the gasket 14 and the annular outwardly rolled flange 26 of the mounting cup. With the gasket 14 so positioned, the gasket and cup are axially aligned and moved relative to each other for introduction of the body 20 of the cup into the downwardly opening chamber 48 of the inserter 42. At this time, the gasket, through the action of the lower portion of the inserter 42, is forcibly engaged with the mounting cup in the sequence illustrated in FIGS. 4, 5 and 6. As will be appreciated from FIG. 8 in particular, the cylindrical body 20 of the cup 12 is closely received within the chamber 48 of the inserter 42 with the shoulder 50 limiting upward movement of the sleeve-like portion of the positioned gasket, thus encouraging proper orientation of this gasket. Similarly, the shoulder 44 will limit inward movement of the cup by engagement of the peripheral edge of the cup flange 26 thereagainst. Depending upon the nature and size of the operation involved, the apparatus may be manually operated or automated by appropriate means not herein specifically illustrated.

Figure 9:
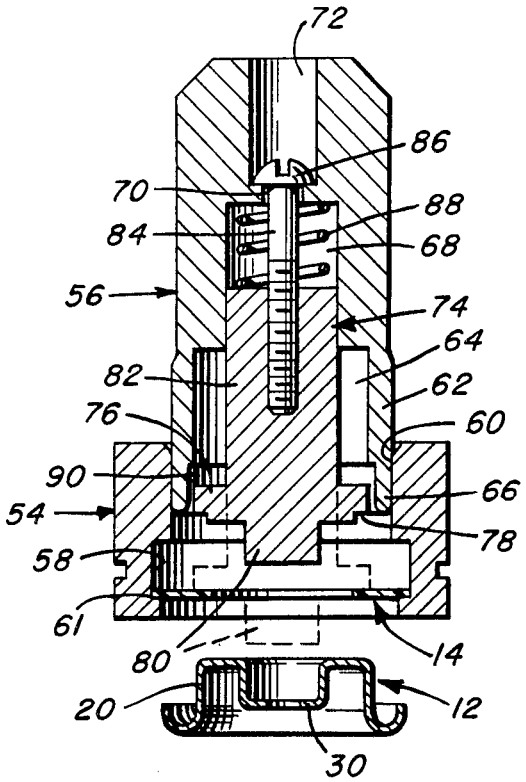
FIGS. 9 and 10 illustrate a preferred embodiment of the gasket mounting apparatus.
Figure 10:
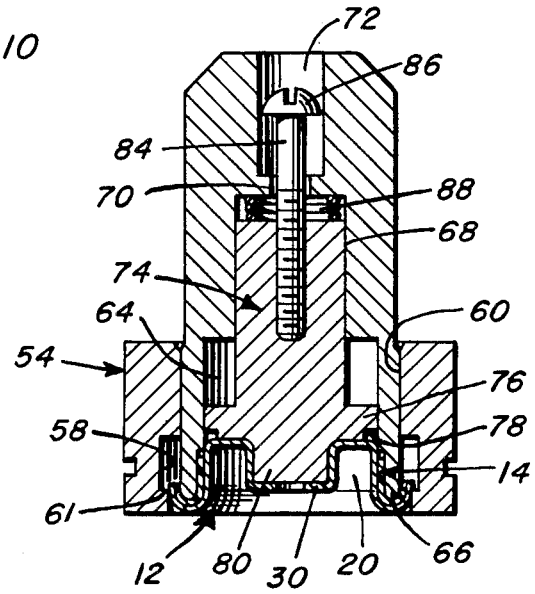

FIGS. 9 and 10 illustrate another, and in fact the preferred embodiment of mounting apparatus for assembling the gasket 14 to the mounting cup 12. FIG. 9 illustrates the apparatus with the gasket received therein and the mounting cup aligned therewith immediately prior to a mounting of the gasket on the cup. FIG. 10 illustrates the apparatus completing the engagement of the gasket with the mounting cup immediately prior to removal of the assembled cup and gasket.

As with the previously described apparatus, the apparatus of FIGS. 9 and 10 includes a tubular guide bushing 54 having a central passage therethrough for the longitudinal reception of an elongated tubular inserter 56.

The guide bushing 54 includes a relatively wide annular recess formed peripherally about the inner wall 60 thereof. This recess 58 is formed toward the lower end of the bushing 54 and defines a narrow annular support shoulder 61 at the lower end thereof. The support shoulder 61 receives, and initially stabilizes and positions, the gasket 14 in a manner which will be readily apparent from FIG. 9. The internal diameter of the bushing 54 at and below the shoulder is slightly less than the internal diameter above the recess 58 with the wall below the recess accommodating the outwardly rolled flange 26 of the cup 12 while the wall above the recess 58 centrally positions and guides the longitudinally moveable inserter for appropriate engagement thereof with the gasket 14 and into the gasket receiving channel 28 of the cup 12.

The inserter 56 is of generally cylindrical construction and includes a lower portion 62 having an external diameter closely although freely receivable within the guide bushing 54 for longitudinal movement relative thereto. The upper portion of the inserter 56 or body thereof, is of a slightly smaller external diameter than the lower portion 62.

A central enlarged downwardly opening chamber 64 is provided within the lower portion 62 and defines an annular lower edge 66. This lower edge 66 is rounded or configured generally to conform to the cup channel 28 for effecting the desired seating of the gasket 14 therein.

An upper chamber 68 communicates centrally with the chamber 64 and is of a reduced diameter relative thereto. The inner or upper end of the upper chamber 68 in turn communicates, through a central reduced diameter aperture 70, with an elongated bore 72 which opens through the upper end of the inserter 56. The bore 72 is of a slightly greater diameter than the aperture 70 while of a smaller diameter than the upper chamber 68.

A centering unit 74 is received within the chambered inserter 56. This unit 74 includes a head 76 configured for close sliding accommodation within the chamber 64. The head in turn includes an annular downwardly directed seat 78 defined peripherally about the lower face thereof for seating engagement of the gasket 14 thereagainst, as will be best noted in the phantom extension of the head 76 shown in FIG. 9. In addition, a cylindrical centering knob or projection 80, of lesser diameter than the annular seat 78, depends centrally from the head for engagement through gasket 14 and into the upwardly directed well 30 of the cup 12, thus combining with the annular seat 78 for alignment of the components to be assembled.

A vertically elongated guide stem 82 is integrally formed with the head 78 and projects centrally therefrom upwardly into guiding relation within the upper chamber 68. The guide stem is in turn retained for limited longitudinal reciprocation by a travel limiter 84 in the nature of an elongated retaining bolt engaged through the aperture 70 and threadedly or otherwise affixed to the stem 82. The upper end of the limiter 84 includes an enlarged head 86 thereon which precludes passage through the aperture 70. The length of the bolt limiter 84 corresponds with the desired length of movement of the centering unit 74.

Finally, an expanded coil compression spring 88 encircles the bolt limiter 84 within the upper portion of the upper chamber 68, engaging between the upper end of the guide stem 82 and the upper end of the upper chamber to effect a resilient biasing of the centering unit 74 to the lower position thereof, limited by engagement of the head 86 with the bottom of the bore 72.

In using the apparatus of FIGS. 9 and 10, the gasket 14 is positioned, in any appropriate manner, within the annular recess 58 of the guide bushing 54 for supporting engagement on the lower shoulder or seat 61. The flexible nature of the gasket 14 allows this to be readily effected. The head 76 on the lower portion of the centering unit 74 aligns with the gasket 14 with the centering knob 80 received through the central aperture of the gasket 14 and with the defined seat 78 receiving the inner portion of the gasket 14. Arranged in this manner, it will be appreciated that the gasket is centrally located and stabilized about both the inner and outer peripheries thereof immediately below the annular lower forming edge 66 of the inserter.

With the gasket 14 so positioned the gasket 14 and the cup 12 are moved relative to each other for introduction of the cup into the guide bushing 54 with the central cylindrical body 20 of the cup moving into the downwardly opening chamber 64 and the centering knob 80 extending into the upwardly opening well 30. Continued relative movement of the cup and gasket toward each other effects a sequence of steps, generally as illustrated in FIGS. 4, 5 and 6, wherein the gasket is forcibly engaged with the mounting cup. This in turn results in a configuring of the initially planar gasket 14 into a sleeve-like inner portion which closely conforms to the annular wall 22 of the cylindrical body 20, and an outer portion which lies within and intimately conforms to the channel 28.

As will be noted in FIGS. 9 and 10, the lower portion of the chamber 64 can be of a slightly larger diameter, as at 90 to accommodate the upward configuration of the inner portion of the gasket 14 to the cylindrical wall 22. Upon completion of the gasket mounting operation, pressure is released with the compressed spring 86 acting to assist in ejecting the cup with mounted gasket therein. As with the previously described apparatus, depending upon the nature and size of the operation involved, the apparatus may be manually operated or automated in any appropriate manner.

From the foregoing, it will be appreciated that a unique gasket for a valve mounting assembly has been defined, along with apparatus and a procedure whereby the gasket, notwithstanding its initial planar or flat configuration, forms a seal which includes a sleeve-like portion surrounding the central cylindrical body of the mounting cup and conforms to and fully fills the body surrounding annular gasket channel.

We claim:

1. A method of assembling a valve mounting assembly including a sealing gasket and a mounting cup for aerosol containers and the like comprising providing a valve mounting cup having a body defined by a cylindrical wall terminating in an outwardly circularly rolled annular surrounding channel, providing an annular planar gasket formed of a self-sustaining deformable resinous material having a uniform thickness with coaxial inner and outer peripheries defining inner and outer diameters respectively, said gasket having top and bottom surfaces and said gasket inner diameter being less than the diameter of said cup cylindrical wall, said gasket outer diameter being greater than the diameter of said cup cylindrical wall, coaxially aligning said gasket normal to and adjacent said cup body, annularly and laterally deforming said gasket into forcible engagement with and about said cup body, and curling said gasket bottom surface outwardly and circularly into intimate frictional engagement with said channel and said cup cylindrical wall.

2. The method of claim 1 comprising encircling the inner peripheral portion of said gasket about said wall to a height above the channel.

3. The method of claim 1 wherein the gasket bottom surface is generally aligned with said channel.

4. The method of claim 3 wherein said gasket materia. comprises a low density polyethylene.

5. The method of claim 4 wherein said gasket has an approximate thickness of about 0.014 inch.

6. The method of claim 1 wherein the outer periphery of said gasket is deformed into general alignment with the periphery of said channel.

* * * * *